US012612778B2

(12) United States Patent
Chen et al.

(10) Patent No.: US 12,612,778 B2
(45) Date of Patent: Apr. 28, 2026

(54) ONE-DIRECTIONAL EXPANSION HOUSE STRUCTURE

(71) Applicant: A&C FUTURE, INC., Newport Beach, CA (US)

(72) Inventors: Shoue Chen, Irvine, CA (US); Sichen Li, Santa Ana, CA (US); Jiuqi Wang, Santa Ana, CA (US); Zhuangboyu Zhou, Santa Ana, CA (US); Yulai Shi, La Puente, CA (US); Ju Gao, Newport Beach, CA (US); Han Qin, Newport Beach, CA (US); Jiayang Qin, Newport Beach, CA (US)

(73) Assignee: A&C FUTURE, INC., Irvine, CA (US)

( * ) Notice: Subject to any disclaimer, the term of this patent is extended or adjusted under 35 U.S.C. 154(b) by 298 days.

(21) Appl. No.: 18/317,828

(22) Filed: May 15, 2023

(65) Prior Publication Data

US 2024/0384524 A1 Nov. 21, 2024

(51) Int. Cl.
*E04B 1/343* (2006.01)

(52) U.S. Cl.
CPC ..... *E04B 1/3431* (2013.01)

(58) Field of Classification Search
CPC .. E04B 1/3431; E04B 1/34384; E04B 1/3442; E04B 1/3444
USPC ..... 52/66, 68, 69
See application file for complete search history.

(56) References Cited

U.S. PATENT DOCUMENTS 1,212,019 A * 1/1917 Coe ..... E04B 7/166 5/10.1
1,285,467 A * 11/1918 Lage ..... E04B 1/345 52/71
1,577,378 A * 3/1926 Smidley ..... A01K 1/02 52/66
1,710,118 A * 4/1929 Smidley ..... A01K 1/02 52/69
1,918,375 A * 7/1933 Bowersock ..... E04B 1/3445 446/109
2,006,477 A * 7/1935 Pendry ..... B60P 3/34 52/68
2,395,691 A * 2/1946 Smith ..... E04B 1/3444 52/272
2,835,931 A * 5/1958 Sterkin ..... E04H 1/12 52/272
3,012,291 A * 12/1961 Rice ..... E04B 1/3442 52/91.1
3,168,762 A * 2/1965 Laidler ..... E04B 1/3442 52/70
3,226,890 A * 1/1966 Flajole ..... E04B 1/3444 296/26.15
3,271,065 A * 9/1966 Scuris ..... B60P 3/34 296/26.02

(Continued)

*Primary Examiner* — James M Ference
(74) *Attorney, Agent, or Firm* — INNOVATION CAPITAL LAW GROUP, LLP; Vic Lin

(57) ABSTRACT

An expandable home structure can expand outward from at least one side thereof to expand the living space once the home is delivered to a desired location. The expansion process includes raising two roof panels from a side edge of its main structure, where the roof panels follow a track so that an outer one of the two roof panels can, once fully raised, slide outward along front and rear walls of the expansion section so that the roof panels form a box gable roof structure over the expansion section.

18 Claims, 9 Drawing Sheets

(56) References Cited

U.S. PATENT DOCUMENTS 3,460,297 A * 8/1969 Fritz ..... E04H 1/02 D25/29
3,469,356 A * 9/1969 White ..... B60P 3/34 296/26.15
3,629,982 A * 12/1971 Ballay ..... E04H 15/18 52/79.5
3,653,165 A * 4/1972 West ..... E04B 1/3442 52/69
3,714,749 A * 2/1973 Aitken ..... E04B 1/3445 D25/26
3,774,956 A * 11/1973 Barlow ..... B60P 3/34 296/156
3,792,557 A * 2/1974 Pitts ..... E04B 1/3444 52/65
3,807,104 A * 4/1974 Webster ..... E04B 1/3445 135/117
3,840,267 A * 10/1974 Honigman ..... B60P 3/34 296/26.02
3,866,365 A * 2/1975 Honigman ..... E04B 1/3444 52/66
4,074,475 A * 2/1978 Wahlquist ..... E04B 1/3445 52/143
4,118,901 A * 10/1978 Johnson ..... E04B 1/345 52/18
4,155,204 A * 5/1979 Prozinski ..... E04B 1/34336 52/69
4,165,117 A * 8/1979 Kaiser ..... B60P 3/34 52/66
4,534,141 A * 8/1985 Fagnoni ..... E04B 1/3444 52/68
4,546,578 A * 10/1985 Behrmann ..... E04B 1/34336 52/79.5
4,633,626 A * 1/1987 Freeman ..... E04B 1/34315 52/79.5
4,829,726 A * 5/1989 de Potter d'Indoye ..... E04B 1/3444 52/64
4,989,379 A * 2/1991 Suzuki ..... E04B 1/3442 52/66
5,596,844 A * 1/1997 Kalinowski ..... E04B 1/3442 52/79.5
6,223,479 B1 * 5/2001 Stockli ..... E04B 1/3444 52/68
6,243,992 B1 * 6/2001 Gyllenhammar ..... B60P 3/34 296/26.05
6,434,895 B1 * 8/2002 Hosterman ..... B62D 63/061 52/79.5
6,705,051 B1 * 3/2004 Wall ..... E04B 7/24 52/93.2
7,418,802 B2 * 9/2008 Sarine ..... E04B 1/34305 52/79.5
7,841,136 B2 * 11/2010 Czyznikiewicz ..... E04B 1/3444 52/64
8,141,304 B2 * 3/2012 Shen ..... E04B 1/3444 52/645
8,267,455 B1 * 9/2012 Ludwick ..... B60P 3/34 296/26.04
8,650,806 B1 * 2/2014 Condie ..... E04H 1/1277 52/79.5
8,739,480 B1 * 6/2014 Bond ..... E04H 9/14 52/167.1
9,376,800 B2 * 6/2016 Martyn ..... E04B 1/34384
D820,469 S * 6/2018 Watson ..... D25/29
10,364,587 B2 * 7/2019 Watson ..... E04B 1/3445
10,837,168 B2 * 11/2020 Rittmanic ..... E04B 1/34321
11,118,344 B2 * 9/2021 Tiramani ..... B32B 15/18
2003/0051417 A1 * 3/2003 Ciotti ..... E04B 1/3442 52/79.5
2006/0185709 A1 * 8/2006 Bzorgi ..... E04H 3/08 135/143
2007/0144078 A1 * 6/2007 Frondelius ..... E04B 1/34305 52/67
2008/0263967 A1 * 10/2008 Culveyhouse ..... E04B 1/3431 52/67
2009/0044460 A1 * 2/2009 Medley ..... E04B 1/3444 52/741.1
2009/0217600 A1 * 9/2009 De Azambuja .... B65D 90/0006 52/79.5
2009/0266006 A1 * 10/2009 Gyory ..... E04B 1/3444 52/79.5
2010/0269419 A1 * 10/2010 Gyory ..... E04B 1/34384 52/79.5
2011/0126479 A1 * 6/2011 Alford ..... E04B 1/3442 52/79.5
2011/0259768 A1 * 10/2011 Campbell ..... E04B 1/3444 206/216
2012/0255240 A1 * 10/2012 Shen ..... E04B 1/34807 52/79.5
2013/0019913 A1 * 1/2013 Zadok ..... E04B 1/3442 135/96
2013/0232887 A1 * 9/2013 Donnini ..... E04B 1/3442 52/79.5
2013/0291449 A1 * 11/2013 Strickland ..... E04B 1/3442 52/79.5
2013/0305626 A1 * 11/2013 Strickland ..... E04B 1/3444 52/79.5
2014/0033619 A1 * 2/2014 Merchant ..... E04B 1/3444 52/71
2016/0069062 A1 * 3/2016 Dynon ..... E04B 1/34336 52/79.5
2017/0030071 A1 * 2/2017 Sorensen ..... E04B 7/163
2017/0037612 A1 * 2/2017 Duncan ..... E04H 1/1205
2018/0079348 A1 * 3/2018 Ronsen ..... B60P 3/34
2019/0078318 A1 * 3/2019 Strong ..... E04B 1/34305
2021/0054614 A1 * 2/2021 Benard ..... E04B 7/22
2021/0246675 A1 * 8/2021 Pearce ..... E04B 1/3448
2022/0161877 A1 * 5/2022 Pollon ..... B60P 3/34
2023/0015863 A1 * 1/2023 Lontz ..... E04C 2/526
2024/0181951 A1 * 6/2024 Zhou ..... B60P 3/34
2024/0200322 A1 * 6/2024 Chen ..... E04B 1/3442
2024/0254754 A1 * 8/2024 Zhou ..... E04B 1/3444
2024/0271410 A1 * 8/2024 Jiang ..... E04B 7/166
2024/0360661 A1 * 10/2024 Wang ..... E04B 1/3442
2024/0384524 A1 * 11/2024 Chen ..... E04B 1/3444

* cited by examiner

ONE-DIRECTIONAL EXPANSION HOUSE STRUCTURE

BACKGROUND OF THE INVENTION

1. Field of the Invention

Embodiments of the invention relate generally to expandable structures. More particularly, embodiments of the invention relate to an expandable house structure that includes a foldable side expansion space and a roof that can be raised and slid along the expansion section to form an inclined, box gable roof structure.

2. Description of Prior Art and Related Information

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

Recently, the expandable house structure is attracting more attention both in the fields of mobile homes and recreational vehicles (RVs). The expansion mode will determine the effective living area, complexity of the driving and control system, and cost for purchase and maintenance. Exploring a concise and reliable folding/expansion mechanism is of great importance. Often, expansion sections, such as recreational vehicle slide-outs, have flat roofs, often requiring more stringent sealing requirements for the expansion section.

In view of the foregoing, there is a need for an expandable house structure that can expand living space while providing a sloped roof over at least a portion of the structure, matching the style and design of conventional homes.

SUMMARY OF THE INVENTION

Embodiments of the present invention aim to solve the aforementioned problems in conventional expandable structures by providing a unique roof storage and deployment structure for storing and deploying a sloped roof system over the expansion section.

Embodiments of the present invention provide an expandable home comprising a main section defining the expandable home in a folded configuration; front and rear expansion walls pivotable from a first side of the main section to form front and rear expansion walls of an expansion section when the expandable home is in the expanded configuration; and a roof structure disposed within the main section, adjacent the first side, when the expandable home is in the folded configuration, wherein: the roof structure is raisable upward through a roof portion of the main structure when the expandable home is in the expanded configuration; the roof structure includes an inside roof panel and an outside roof panel, pivotably attached to each other along upper edges thereof; and the outer roof panel is slidable along the front and rear expansion walls to form a box gable roof structure over the expansion section.

Embodiments of the present invention provide an expandable home comprising a main section defining the expandable home in a folded configuration; front and rear expansion walls pivotable from a first side of the main section to form the front and rear expansion walls of an expansion section when the expandable home is in the expanded configuration; a track formed horizontally in the front and rear expansion walls; inside and outside channels formed along an interior surface of each of a front wall and a rear wall of the main structure, wherein the inside roof panel moves along the inside channel and the outside roof panel moves along the outside channel when the roof structure is raised out of the roof portion of the main structure; and a roof structure disposed within the main section, adjacent the first side, when the expandable home is in the folded configuration, wherein: the roof structure includes an inside roof panel and an outside roof panel, pivotably attached to each other along upper edges thereof; the inside roof panel is movable along the inside channel and the outside roof panel is movable along the outside channel to cause the roof structure to move upward through a roof portion of the main structure when the expandable home is moved into the expanded configuration; the inside and outside channels are generally parallel with each other at a lower portion thereof; the outside channel angles away from the inside channel at an upper portion thereof; the inside channel terminates at a maximum height adjacent a top edge of the front and rear walls of the main structure; the outside channel terminates at the maximum height at an access opening formed in the outer edge of the front and rear walls of the main structure; and the access opening communicates with the track to permit the outside roof panel to move from the outside channel to the track.

These and other features, aspects and advantages of the present invention will become better understood with reference to the following drawings, description and claims.

BRIEF DESCRIPTION OF THE DRAWINGS

Some embodiments of the present invention are illustrated as an example and are not limited by the figures of the accompanying drawings, in which like references may indicate similar elements.

Figure 1:
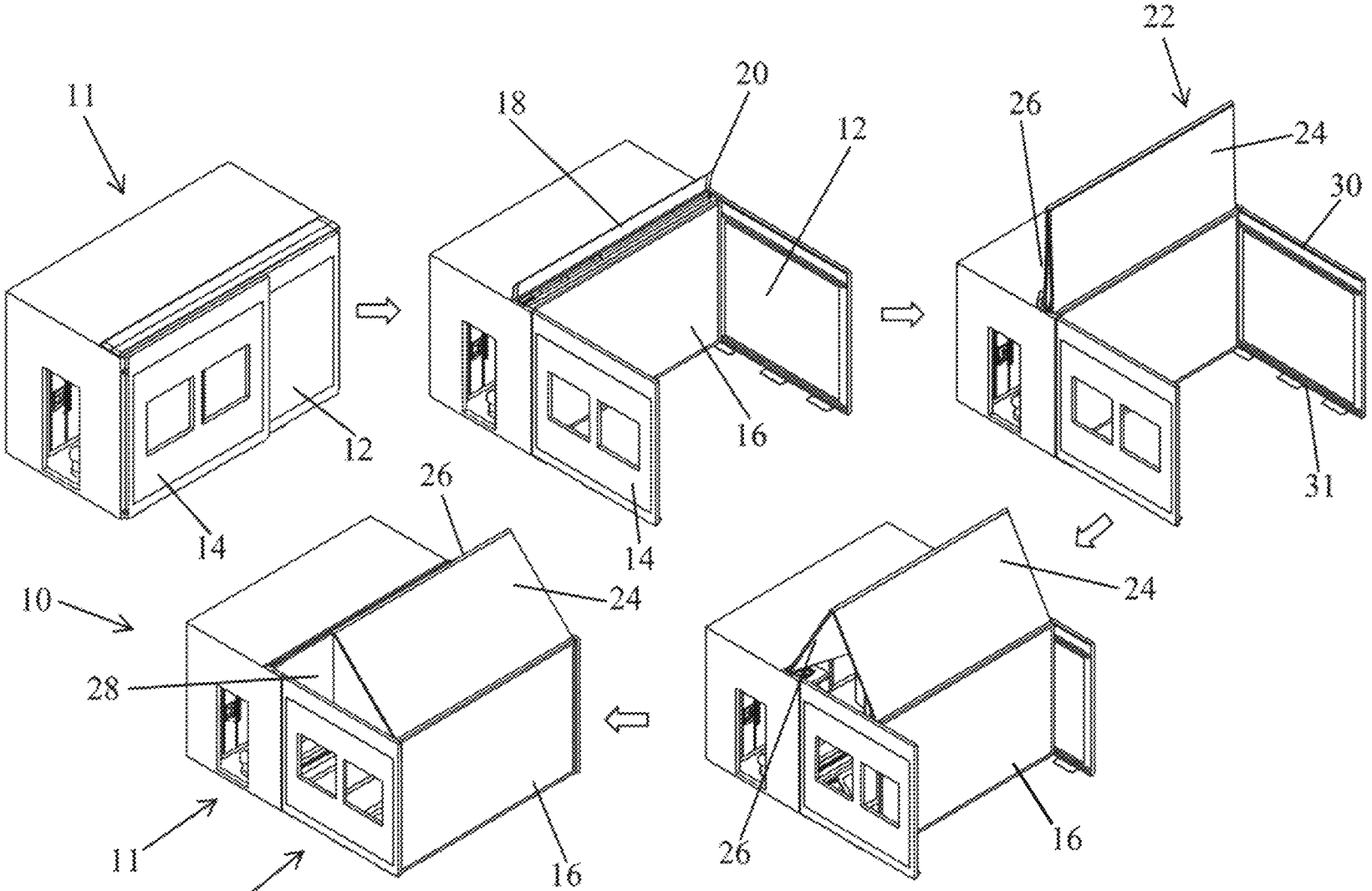
FIG. 1 illustrates a perspective view of a home expansion process according to an exemplary embodiment of the present invention.

The illustrations in the figures may not necessarily be drawn to scale.

The invention and its various embodiments can now be better understood by turning to the following detailed description wherein illustrated embodiments are described. It is to be expressly understood that the illustrated embodiments are set forth as examples and not by way of limitations on the invention as ultimately defined in the claims.

DETAILED DESCRIPTION OF THE PREFERRED EMBODIMENTS AND BEST MODE OF INVENTION

The terminology used herein is for the purpose of describing particular embodiments only and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

In the following description, for purposes of explanation, numerous specific details are set forth in order to provide a thorough understanding of the present invention. It will be evident, however, to one skilled in the art that the present invention may be practiced without these specific details.

The present disclosure is to be considered as an exemplification of the invention and is not intended to limit the invention to the specific embodiments illustrated by the figures or description below.

As is well known to those skilled in the art, many careful considerations and compromises typically must be made when designing for the optimal configuration of a commercial implementation of any system, and in particular, the embodiments of the present invention. A commercial implementation in accordance with the spirit and teachings of the present invention may be configured according to the needs of the particular application, whereby any aspect(s), feature(s), function(s), result(s), component(s), approach(es), or step(s) of the teachings related to any described embodiment of the present invention may be suitably omitted, included, adapted, mixed and matched, or improved and/or optimized by those skilled in the art, using their average skills and known techniques, to achieve the desired implementation that addresses the needs of the particular application.

Broadly, embodiments of the present invention provide an expandable home structure that can expand outward from at least one side thereof to expand the living space once the home is delivered to a desired location. The expansion process includes raising two roof panels from a side edge of its main structure, where the roof panels follow a track so that an outer one of the two roof panels can, once fully raised, slide outward along front and rear walls of the expansion section so that the roof panels form a box gable roof structure over the expansion section.

Referring to FIG. 1, an expandable home 10 can include a main section 11 and an expansion section 13. During a first step, a front expansion wall 14 and a rear expansion wall 12 can pivot away from the side of the main section 11, revealing an outer expansion wall 16. A roof flap 18, 20 can pivot from the roof 36 of the main section 11 to reveal a roof structure 22 therein. The roof structure 22 can be raised, as described in greater detail below, to raise the roof structure 22 as shown in the third image of FIG. 1.

The roof structure 22 can include an outer roof panel 24 and an inner roof panel 24. A lower part of the outer roof panel 24 can slide along a track 30, as described in greater detail below, while the upper part of the outer roof panel 24 can be pivotably attached to the upper part of the inner roof panel 26. As the outer roof panel 24 slides along the track, the roof structure 22 can form a box gable roof covering the expansion section 13.

In some embodiments, as discussed in greater detail below, the outer roof panel 24 may be attached to the outer expansion wall 16, so that movement outward of the outer expansion wall 16, as shown in the fourth image of FIG. 1, causes expansion of the roof structure 22. The outer expansion wall 16 may move via various mechanisms, such as a direct drive mechanism, hydraulic arms, screw drives, or by pushing out the floor 40, which may be attached to a bottom edge of the outer expansion wall 16. In some embodiments, a track 31 may be formed in the front and rear expansion walls 14, 12 to help guide the outer expansion wall 16 during expansion and retraction. The track 31 may communicate with notches 50 formed in a rear wall 38 of the main section 11 to permit storage of the outer expansion wall 16 within the main section 11 and to permit folding of the front and rear expansion walls 14, 12 over the outer expansion wall 16.

As the roof panels 24, 26 are expanded, as shown in the last image of FIG. 1, side panels 28 may be unfolded to form an outer wall between the front and rear expansion walls 14, 12 and the roof panels 24, 26.

Figure 2:
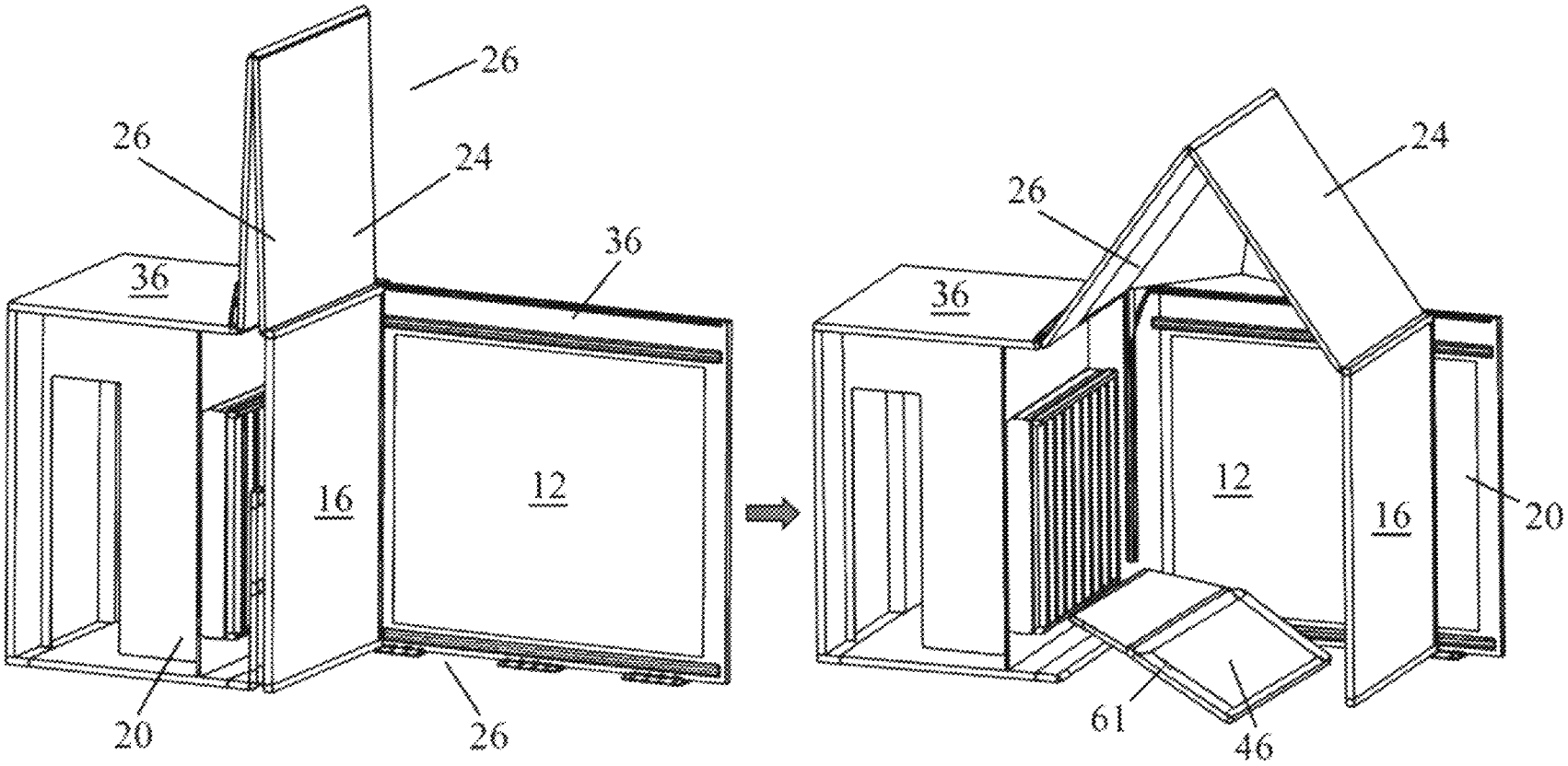
FIG. 2 illustrates a detailed perspective view of a back wall expansion and roof raising, followed by roof and floor unfolding, as part of the home expansion process of FIG. 1.

FIG. 2 shows a cut away view of the expansion of the outer expansion wall 16 once the roof structure 22 is fully raised. The floor 40 may be a bifold floor, as shown, or may be formed in various other structures, such as a single floor member that may slide down the outer expansion wall 16 during expansion, or as a multi-folding floor, for example.

Figure 3:
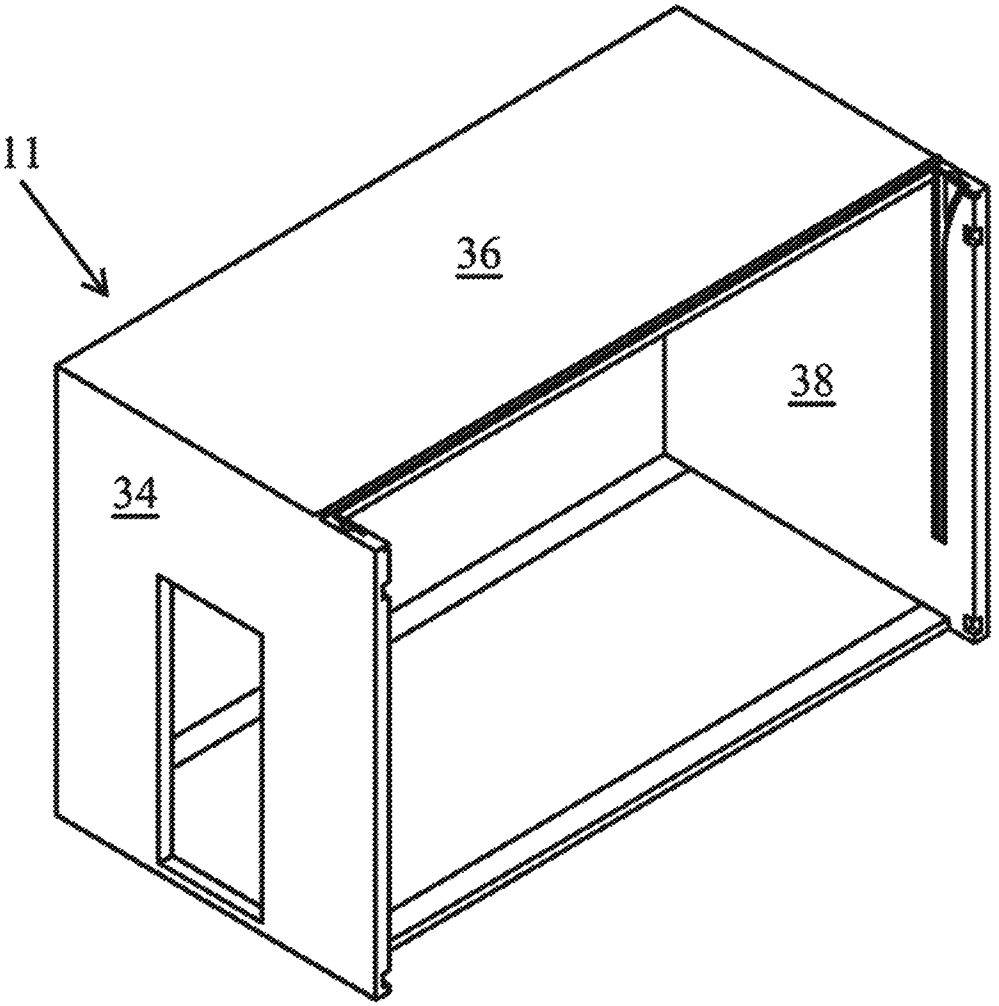
FIG. 3 illustrates a perspective view of the main structure of the expandable home of FIG. 1, with the expansion components removed for clarity.
Figure 4B:
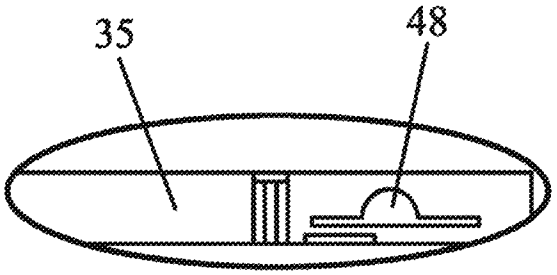
FIG. 4B illustrates a detailed top view of the foldable wall of FIG. 4A.
Figure 4A:
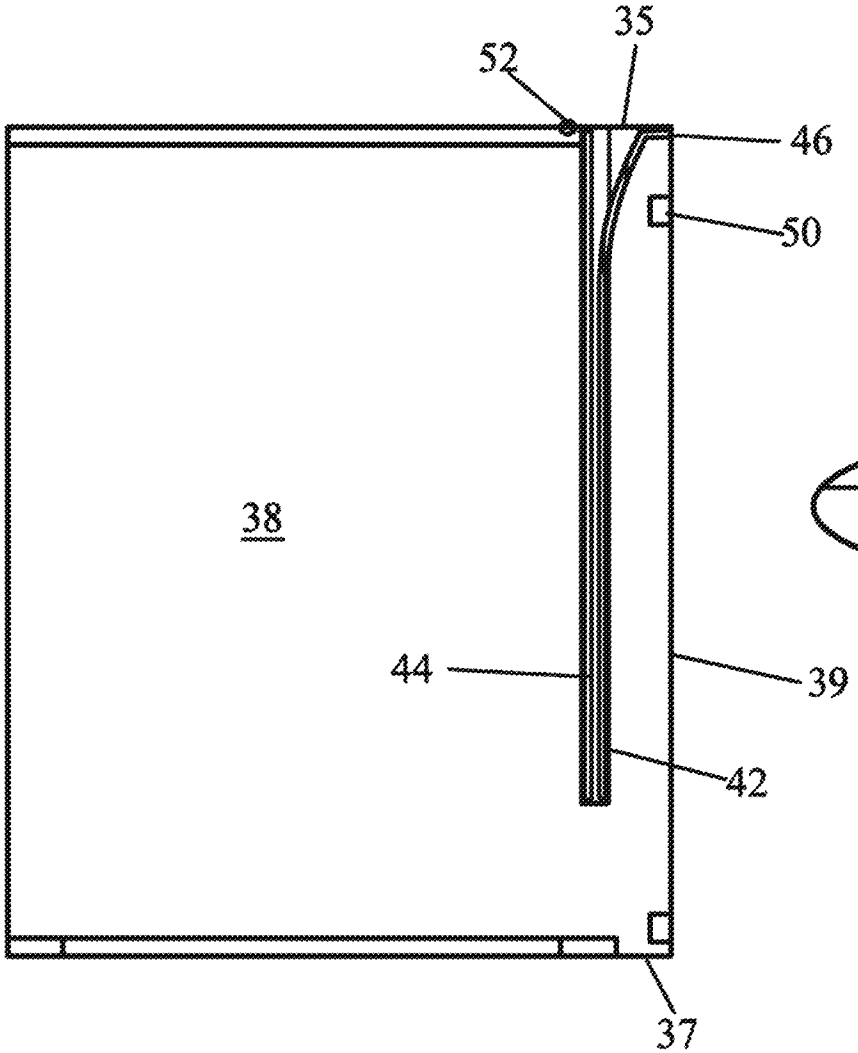
FIG. 4A illustrates a detailed inside side view of a main structure back wall of the expandable structure, according to an exemplary embodiment of the present invention.
Figure 5:
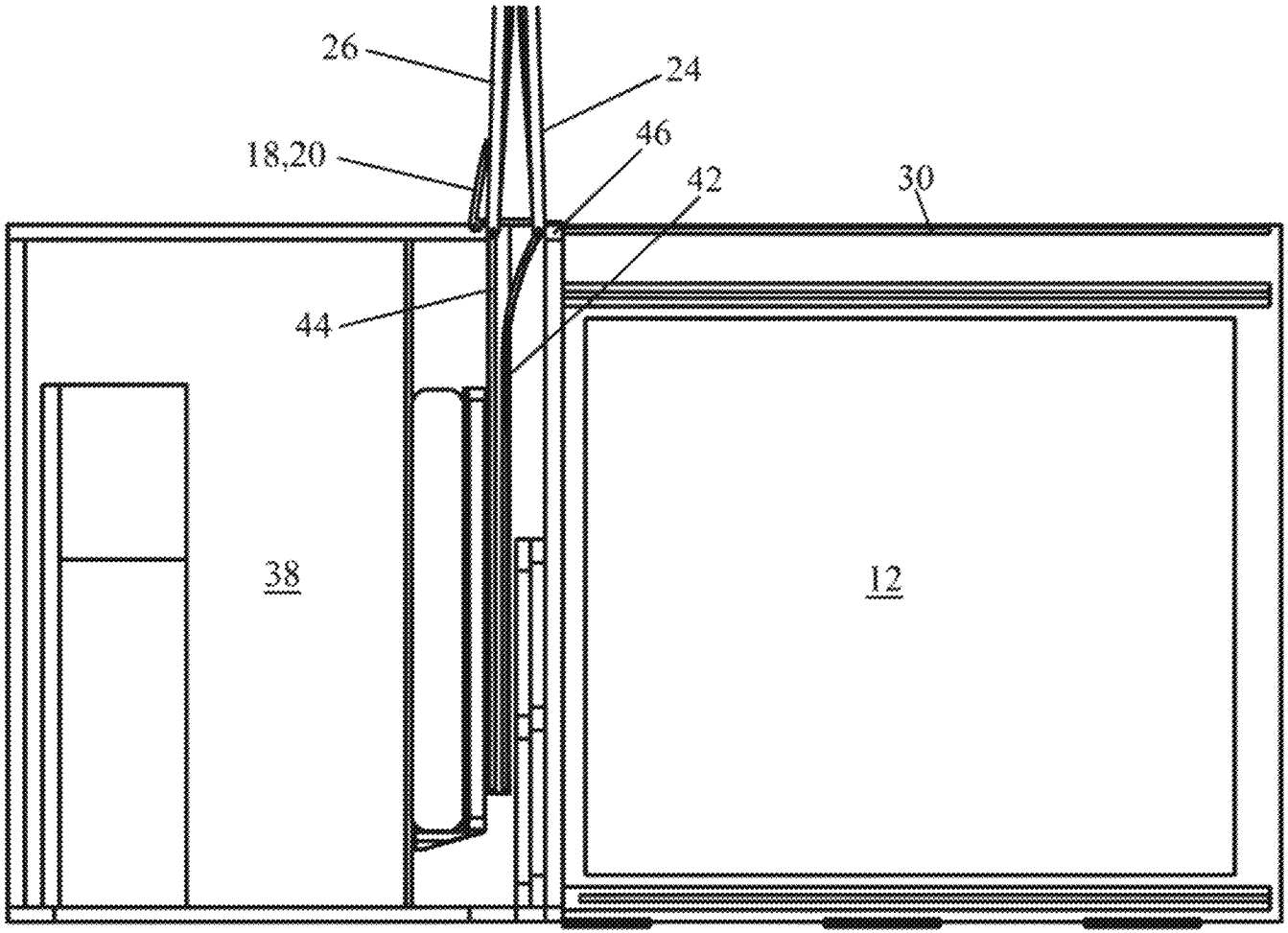
FIG. 5 illustrates a partially cut-away front view, showing the roof fully raised, prior to sliding over the expansion section, according to an exemplary embodiment of the present invention.

Referring now to FIGS. 3 through 5, a rear wall 38 of the main section 11 can include an inside channel 44 and an outside channel 42. The channels 42, 44 may extend along an interior surface, adjacent an outer edge 39 of the rear wall 38, starting near a lower edge 37 of the rear wall and extending to terminate at or adjacent a top edge 35 of the rear wall 38. For example, the channels 42, 44 may be from about 2 to 24 inches from the outer edge 39 of the rear wall. The channels 42, 44 may also terminate about 0 to about 2 inches from the top edge 35 of the rear wall.

The channels 42, 44 may be generally parallel with each other from their lower starting point upward, running generally parallel with the outer edge 39 of the rear wall. As used herein, the term "generally parallel" may include both true parallel, as well as minor divergence from true parallel, such as a divergence of 0 to 5 degrees, for example.

As the channels 42, 44 extend upward along the interior surface of the rear wall 38, the outside channel 42 may curve outward so that when the outside channel 42 reaches its uppermost height, the outside channel 42 is spaced apart from the inside channel 44 a given distance. This distance may be from about 2 inches to about 18 inches, for example. The outside channel 42 may terminate at the outer edge 39 of the rear wall, where an access opening 46 to the outside channel 42 may be provided from the outer edge 39, as may be best seen in FIG. 6A.

As shown in FIG. 4B, a channel 48 may be formed, from the top edge 35 of the rear wall 38, along a rear part of the outside and inside channels 42, 44. As described below, the channel 48 may hold a roof lifting mechanism form raising and lowering the roof structure 22. The outside and inside channels 42, 44 can communicate with the channel 48, such that access to the channel 48 may be provided along the channels 42, 44 of the interior of the rear wall 38.

Figure 6B:
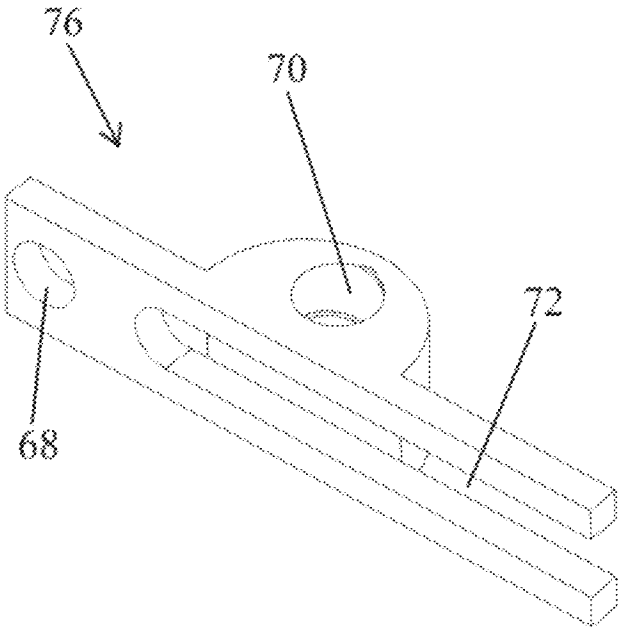
FIG. 6B illustrates a perspective view of a shafting lifting panel, according to an exemplary embodiment of the present invention.
Figure 6A:
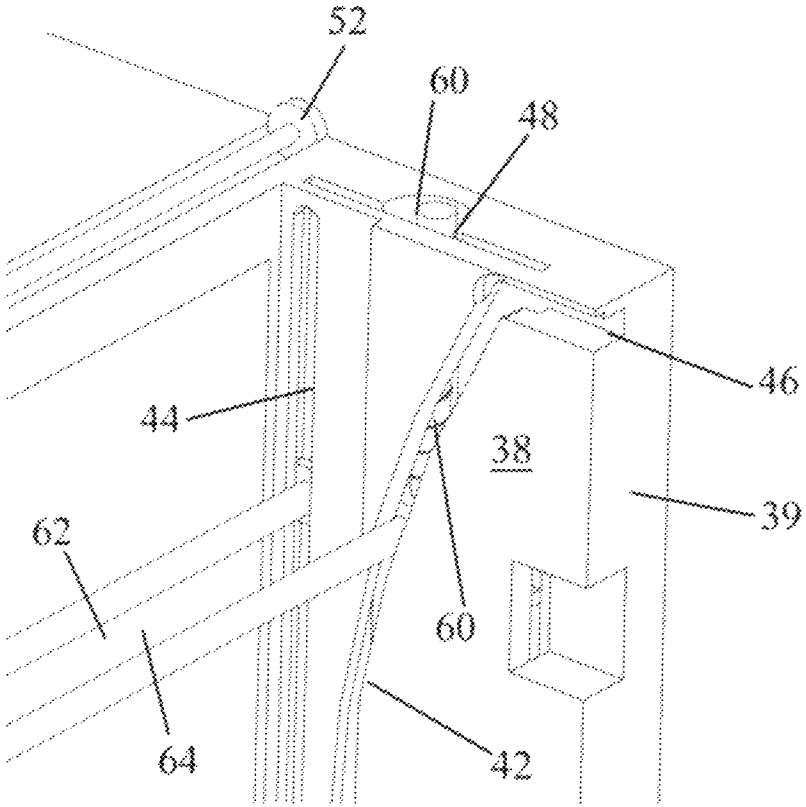
FIG. 6A illustrates a detailed perspective view of the main structure back wall, showing movement of shafts of the roof structure in channels during raising of the roof, where the roof is removed for clarity.

Also referring to FIG. 6A, it can be seen how a rotation axis 52 is provided for the roof flaps 18, 20. The roof flaps 18, 20 may open to permit the roof structure 22 to be raised out of the main section 11. The roof flaps 18, 20 can include a main roof flap 20 that an remain open whenever the roof structure 22 is raised, and side roof flaps, that can move independently of the main roof flap 20, and can cover the channel 48 after the roof structure 22 is raised.

Referring now to FIGS. 6A and 6B, a lifting structure is described. Inside shaft 62 may span from the channel 48, out through the inside channel 44 of the rear wall 38 and can extend to a corresponding channel 48 and inside channel 44 of the front wall 34 (not shown). Similarly, an outside shaft 64 may span from the channel 48, out through the outside channel 42 of the rear wall 38 and can extend to a corresponding channel 48 and outside channel 42 of the front wall 34 (not shown). The inside and outside shafts 62, 64 may connect to a lifting panel 76. The inside shaft 62 may be disposed in a fixed position of the lifting panel 76, while the outside shaft 64 may be disposed in an open slot 72 formed in the lifting panel, where the open slot 72 permits the outside shaft 64 to move along the outside channel 42 and out of the open slot 72, to then move along and out of the access opening 46 and, subsequently, along the track 31 formed in the front and rear expansion walls 14, 12.

The lifting panel 76 can include a threaded opening 70 therethrough, where the threaded opening 70 extends generally orthogonal to the open slot 72, and circular opening 68 distal from the open slot. The threaded opening allows the lifting panel 76 to move along a threaded shaft 60 formed along the channel 48. Thus, turning of the threaded shaft 60 can raise or lower the lifting panel 76 which, in turn, raised or lowers the outside and inside shafts 62, 64. The threaded shaft 60 can spread from the channel 48 to the channel 42.

The inside shaft 62 may be attached to a lower portion of the inner roof panel 26. The outside shaft 64 may be attached to a lower portion of the outer roof panel 24. Thus, movement of the inside and outside shafts 62, 64 can cause movement of the roof structure 22. As can be appreciated, either the shafts 62, 64 may rotate, or the roof panels 24, 26 may pivot relative to the shafts 62, 64 during movement of the roof panels 24, 26 to form the box gable roof structure.

Figure 7:
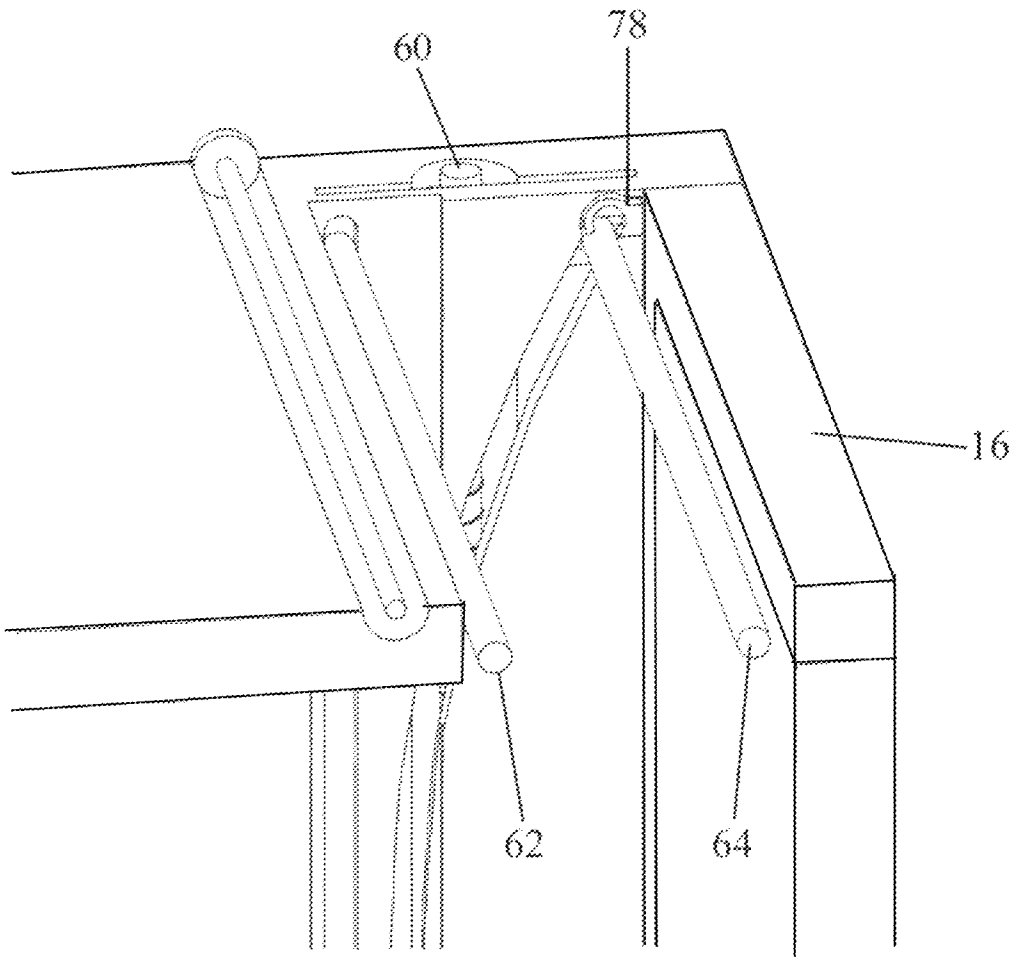
FIG. 7 illustrates a detailed, partially cut-away view of the roof shafts in a fully raised configuration, where the folding back wall of the expansion section is shown in a folded state, according to an exemplary embodiment of the present invention.
Figure 8B:
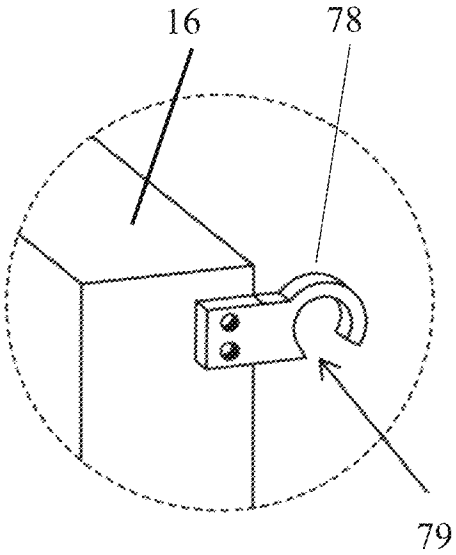
FIG. 8B illustrates a detailed perspective end view of the sliding outer wall of FIG. 8A.
Figure 8A:
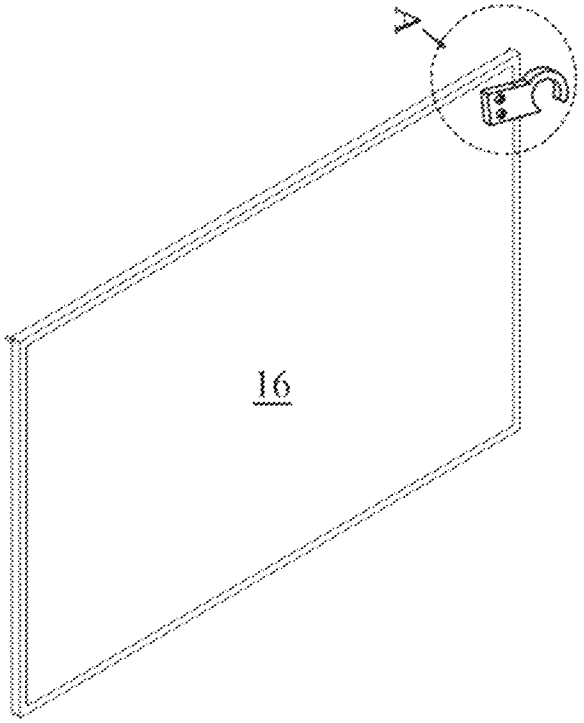
FIG. 8A illustrates a perspective view of a sliding outer wall, according to an exemplary embodiment of the present invention.

Referring now to FIGS. 7 through 8B, the outer expansion wall 16 may include a connector 78 that can engage the outside shaft 64 once it is raised to its uppermost position. In some embodiments, the connector 78 may be formed in a downward facing C-shape, where the opening 79 of the C-shape may be smaller than the diameter of the outside shaft 64. The opening 79 of the C-shape may be resiliently expanded as the outside shaft 64 moves upward and moves inside the connector 78. With the outside shaft 64 fixed inside the connector 78, the outer expansion wall 16 can expand and the outside shaft 64 may slide along the track 31 formed in the front and rear expansion walls 14, 12.

Figure 10:
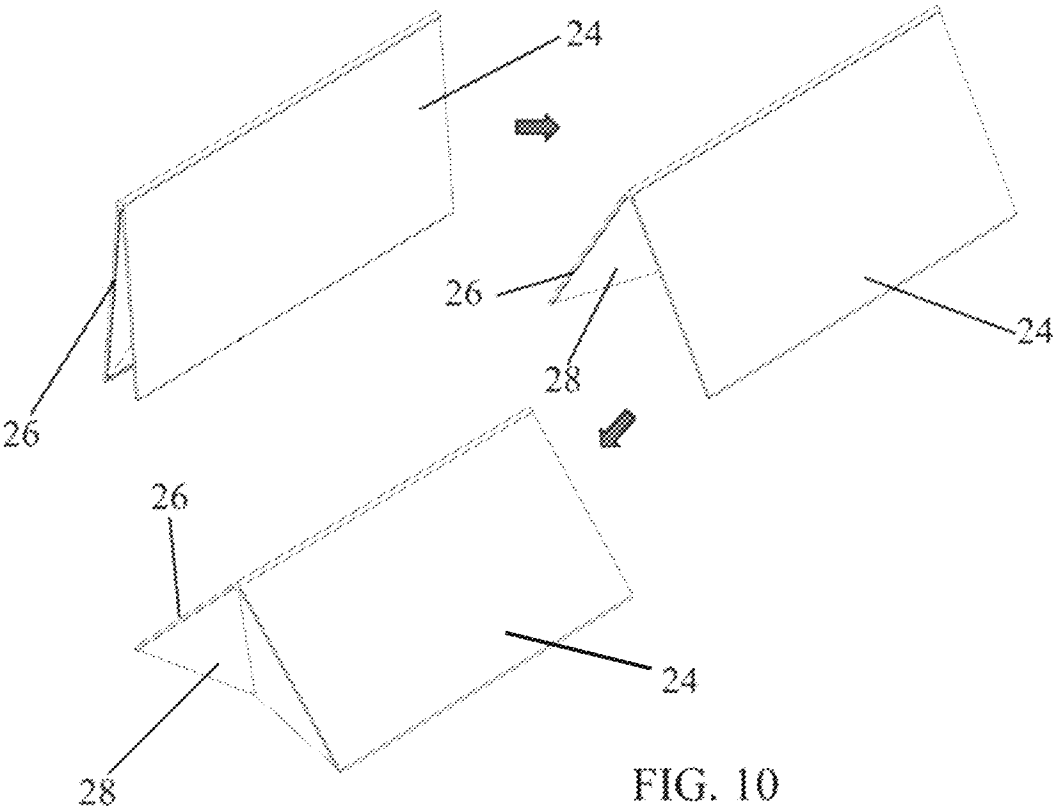
FIG. 10 illustrates a perspective view showing the separation of the roof panels during raising thereof, followed by the formation of the box gable roof structure as the roof is slid along the expansion section of the expandable home, according to an exemplary embodiment of the present invention.
Figure 9:
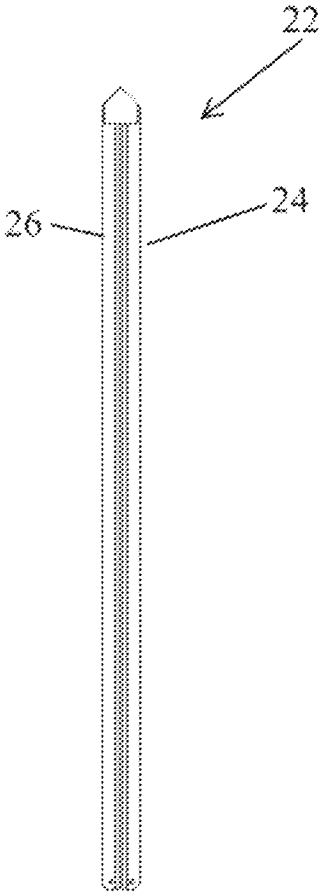
FIG. 9 illustrates a side view of the roof structure, in a folded state, according to an exemplary embodiment of the present invention.

As shown in FIG. 9, the roof structure 22 is folded, where the roof panels 24, 26 are generally parallel with each other. FIG. 10 shows an exemplary embodiment of the unfolding of the roof structure 22, including the unfolding of the side panels 28.

It should be understood that the terms front, rear and side, as used herein, are meant to describe the relative positions of various components of the disclosed structure, and should not be read to be limiting in the sense of an actual position of the structure. While the front wall 34 of the main section 11 has a door opening and opposes the rear wall 38 of the main section (see FIG. 3), these front and rear designators could be reversed without departing from the present invention as described herein. For example, one could describe the outer expansion wall 16 as being folded into a front of the main section 11, where, in this example, the expansion walls that unfold from the main section 11 would be considered left and right side expansion walls instead of front and rear expansion walls.

While a single expansion section is illustrated, it should be understood that expansion sections may be disposed on opposite sides of the main section, where a box gable roof structure can be formed over both expansion sections.

All the features disclosed in this specification, including any accompanying abstract and drawings, may be replaced by alternative features serving the same, equivalent or similar purpose, unless expressly stated otherwise. Thus, unless expressly stated otherwise, each feature disclosed is one example only of a generic series of equivalent or similar features.

Claim elements and steps herein may have been numbered and/or lettered solely as an aid in readability and understanding. Any such numbering and lettering in itself is not intended to and should not be taken to indicate the ordering of elements and/or steps in the claims.

Many alterations and modifications may be made by those having ordinary skill in the art without departing from the spirit and scope of the invention. Therefore, it must be understood that the illustrated embodiments have been set forth only for the purposes of examples and that they should not be taken as limiting the invention as defined by the following claims. For example, notwithstanding the fact that the elements of a claim are set forth below in a certain combination, it must be expressly understood that the invention includes other combinations of fewer, more or different ones of the disclosed elements.

The words used in this specification to describe the invention and its various embodiments are to be understood not only in the sense of their commonly defined meanings, but to include by special definition in this specification the generic structure, material or acts of which they represent a single species.

The definitions of the words or elements of the following claims are, therefore, defined in this specification to not only include the combination of elements which are literally set forth. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a subcombination or variation of a subcombination.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

The claims are thus to be understood to include what is specifically illustrated and described above, what is conceptually equivalent, what can be obviously substituted and also what incorporates the essential idea of the invention.

What is claimed is:

1. An expandable home comprising:

a main section defining the expandable home in a folded configuration;

front and rear expansion walls pivotable from a first side of the main section to form front and rear expansion walls of an expansion section when the expandable home is in an expanded configuration; and a roof structure disposed within the main section, adjacent the first side, when the expandable home is in the folded configuration, wherein:

the roof structure is raisable upward through a roof portion of the main section when the expandable home is in the expanded configuration;

the roof structure includes an inside roof panel and an outside roof panel, pivotably attached to each other along upper edges thereof;

the outer roof panel is slidable along the front and rear expansion walls to form a box gable roof structure over the expansion section;

a track formed in the front and rear expansion walls, wherein the outside roof panel is movable along the track to move into the expanded configuration; and inside and outside channels formed along an interior surface of each of a front wall and a rear wall of the main section, wherein the inside roof panel moves along the inside channel and the outside roof panel moves along the outside channel when the roof structure is raised out of the roof portion of the main section.

2. The expandable home of claim 1, wherein:

the inside and outside channels are generally parallel with each other at a lower portion thereof; and the outside channel angles away from the inside channel at an upper portion thereof.

3. The expandable home of claim 1, wherein:

the inside channel terminates at a maximum height adjacent a top edge of the front and rear walls of the main section; and the outside channel terminates at the maximum height at an access opening formed in the outer edge of the front and rear walls of the main section.

4. The expandable home of claim 3, wherein the access opening communicates with the track to permit the outside roof panel to move from the outside channel to the track.

5. The expandable home of claim 1, further comprising an outer expansion wall movable between the folded configuration, with the outer expansion wall disposed in the main section, and the expanded configuration, with the outer expansion wall defining an outer wall between the front and rear expansion walls.

6. The expandable home of claim 5, wherein the outer expansion wall is attached to a floor member, the floor member expandable into a floor of the expansion section when the outer expansion wall is moved into the expanded configuration.

7. The expandable home of claim 5, wherein the outer expansion wall connects to the outside roof panel with a connector prior to moving along the track in the front and rear expansion walls.

8. The expandable home of claim 7, wherein the connector has a C-shape with an opening of the C-shape smaller than a connection portion of the outside roof panel, the opening resiliently expanding to receive the connection portion.

9. The expandable home of claim 8, wherein the connection portion includes an outside shaft attached to a lower portion of the outside roof panel.

10. The expandable home of claim 9, further comprising an inside shaft attached to a lower portion of the inside roof panel, wherein the inside shaft moves along the inside channel and the outside shaft moves along the outside channel.

11. The expandable home of claim 10, further comprising a lifting panel, the lifting panel having a first fixed location for receiving the inside shaft and an open slot for receiving the outside shaft therein, wherein the second shaft exits the open slot when the expandable home moves from the folded configuration to the expanded configuration.

12. The expandable home of claim 11, further comprising a threaded rod disposed vertically in the front and rear walls of the main section, the lifting panel configured to move along the threaded rod to raise and lower the roof structure.

13. The expandable home of claim 1, further comprising side panels foldably disposed between the inside and outside roof panels in the folded configuration, wherein the side panels span between the inside and outside roof panels at a front and rear side thereof, when the expandable home is in the expanded configuration.

14. An expandable home comprising:

a main section defining the expandable home in a folded configuration;

front and rear expansion walls pivotable from a first side of the main section to form the front and rear expansion walls of an expansion section when the expandable home is in an expanded configuration;

a track formed horizontally in the front and rear expansion walls;

inside and outside channels formed along an interior surface of each of a front wall and a rear wall of the main section, wherein an inside roof panel moves along the inside channel and an outside roof panel moves along the outside channel when a roof structure is raised out of a roof portion of the main section; and the roof structure disposed within the main section, adjacent the first side, when the expandable home is in the folded configuration, wherein:

the roof structure includes the inside roof panel and the outside roof panel, pivotably attached to each other along upper edges thereof;

the inside roof panel is movable along the inside channel and the outside roof panel is movable along the outside channel to cause the roof structure to move upward through the roof portion of the main section when the expandable home is moved into the expanded configuration;

the inside and outside channels are generally parallel with each other at a lower portion thereof;

the outside channel angles away from the inside channel at an upper portion thereof;

the inside channel terminates at a maximum height adjacent a top edge of the front and rear walls of the main section;

the outside channel terminates at the maximum height at an access opening formed in the outer edge of the front and rear walls of the main section; and the access opening communicates with the track to permit the outside roof panel to move from the outside channel to the track.

15. The expandable home of claim 14, further comprising an outer expansion wall movable between the folded configuration, with the outer expansion wall disposed in the main section, and the expanded configuration, with the outer expansion wall defining an outer wall between the front and rear expansion walls, wherein the outer expansion wall connects to the outside roof panel with a connector prior to moving along the track in the front and rear expansion walls.

16. The expandable home of claim 15, wherein the connector has a C-shape with an opening of the C-shape smaller than a connection portion of the outside roof panel, the opening resiliently expanding to receive the connection portion.

17. The expandable home of claim 16, further comprising:

an inside shaft attached to a lower portion of the inside roof panel; and an outside shaft attached to a lower portion of the outside roof panel, wherein:

the inside shaft moves along the inside channel and the outside shaft moves along the outside channel; and the connection portion removably attached to the outside shaft when the roof structure is raised to a maximum height of the roof.

18. The expandable home of claim 17, further comprising:

a lifting panel, the lifting panel having a first fixed location for receiving the inside shaft and an open slot for receiving the outside shaft therein, wherein the second shaft exits the open slot when the expandable home moves from the folded configuration to the expanded configuration; and a threaded rod disposed vertically in the front and rear walls of the main section, the lifting panel configured to move along the threaded rod to raise and lower the roof structure.

* * * * *